US008931778B2

(12) United States Patent
Laniewicz

(10) Patent No.: US 8,931,778 B2
(45) Date of Patent: Jan. 13, 2015

(54) FUNCTIONAL JEWELRY

(71) Applicant: Critsuccess LLC, McLean, VA (US)

(72) Inventor: Aaron Laniewicz, McLean, VA (US)

(73) Assignee: Critsuccess LLC, Washington, DC (US)

( * ) Notice: Subject to any disclaimer, the term of this patent is extended or adjusted under 35 U.S.C. 154(b) by 0 days.

(21) Appl. No.: 14/215,927

(22) Filed: Mar. 17, 2014

(65) Prior Publication Data

US 2014/0265114 A1 Sep. 18, 2014

Related U.S. Application Data

(60) Provisional application No. 61/792,974, filed on Mar. 15, 2013.

(51) Int. Cl.

| | |
|---|---|
| ***A63F 1/18*** | (2006.01) |
| ***A63F 11/00*** | (2006.01) |
| ***A44C 9/00*** | (2006.01) |
| ***A63F 5/04*** | (2006.01) |
| ***A63F 9/00*** | (2006.01) |

(52) U.S. Cl.

CPC ..... *A63F 11/0011* (2013.01); *A44C 9/00* (2013.01); *A63F 5/043* (2013.01); *A63F 5/045* (2013.01); *A63F 9/001* (2013.01); *A63F 2009/003* (2013.01); *A63F 2250/491* (2013.01)

USPC ..... 273/143 R

(58) Field of Classification Search

CPC ..... A63F 11/00; A63F 11/0011

USPC ..... 273/143

See application file for complete search history.

(56) References Cited

U.S. PATENT DOCUMENTS

| | | | | | |
|---|---|---|---|---|---|
| 1,586,606 | A | * | 6/1926 | Cain | 63/1.12 |
| 1,672,355 | A | * | 6/1928 | Ullman | 63/1.13 |
| 2,185,811 | A | * | 1/1940 | Heyman | 63/1.12 |
| 2,453,955 | A | * | 11/1948 | Younghusband | 63/15 |
| 3,716,237 | A | * | 2/1973 | Locher | 273/142 H |
| 4,346,900 | A | * | 8/1982 | Lamlee | 273/274 |
| D266,062 | S | * | 9/1982 | Austin | D11/26 |
| 5,228,316 | A | * | 7/1993 | Meyrowitz | 63/15.4 |
| 5,232,222 | A | * | 8/1993 | Deutch | 273/142 HA |
| 5,483,808 | A | * | 1/1996 | Barbazza | 63/15.5 |
| 5,575,161 | A | * | 11/1996 | Hinchey | 63/33 |
| 5,701,765 | A | * | 12/1997 | Cerqua | 63/15.4 |
| 5,987,919 | A | * | 11/1999 | Hooser | 63/15 |
| 6,032,485 | A | * | 3/2000 | Steinberg | 63/15 |
| 6,176,189 | B1 | * | 1/2001 | Tomita | 112/102.5 |
| 6,395,732 | B1 | * | 5/2002 | Zimmermann et al. | 514/227.8 |
| 6,497,117 | B2 | * | 12/2002 | Ofiesh, II | 63/15 |
| 7,704,135 | B2 | | 4/2010 | Harrison, Jr. | |
| 7,850,251 | B1 | * | 12/2010 | Sadanowicz | 301/6.8 |
| 7,905,769 | B1 | | 3/2011 | Harrison, Jr. | |
| 8,033,547 | B1 | * | 10/2011 | Bryce | 273/146 |
| 8,448,464 | B2 | * | 5/2013 | Varcin | 63/15.6 |
| 8,677,624 | B2 | * | 3/2014 | Mardkha | 29/896.412 |

* cited by examiner

*Primary Examiner* — Michael Dennis
*Assistant Examiner* — Dolores Collins
(74) *Attorney, Agent, or Firm* — Ladas & Parry LLP

(57) ABSTRACT

Dice rings are designed in a way that one or multiple outer thinner ring(s) spin in a grooved inner ring that slips onto a finger. The outer smaller ring may have numbers, characters, symbols or words distributed around the ring such that when spun, a random result is produced, designated by an indicator marking on the sides of the grooved inner ring.

20 Claims, 24 Drawing Sheets

FIG. 2G

290

| Left Band | | Right Band | |
|---|---|---|---|
| 0 | 11.73% | 4 | 3.21% |
| – | 9.57% | 2 | 16.14% |
| + | 9.57% | 1 | 25.80% |
| – | 9.57% | | |
| + | 9.57% | | |
| 0 | 11.73% | 3 | 12.91% |
| + | 9.57% | 2 | 16.14% |
| – | 9.57% | 1 | 25.80% |
| + | 9.57% | | |
| – | 9.57% | | |
| Sum: | 100.00% | Sum: | 100.00% |

291

| Left Band | | Right Band | |
|---|---|---|---|
| → | 4.63% | 5 | 30.00% |
| 10 | 12.50% | 18 | 5.00% |
| 6 | 4.63% | 4 | 15.00% |
| 12 | 11.57% | 16 | 30.00% |
| 8 | 9.72% | 3 | 5.00% |
| 14 | 6.94% | 17 | 15.00% |
| → | 4.63% | Sum: | 100.00% |
| 11 | 12.50% | | |
| 7 | 6.94% | | |
| 13 | 9.72% | | |
| 9 | 11.57% | | |
| 15 | 4.63% | | |
| Sum: | 100.00% | | |

292

| | |
|---|---|
| HOSTILE | 20.00% |
| UNFRIENDLY | 20.00% |
| N | 10.00% |
| FRIENDLY | 20.00% |
| HELPFUL | 20.00% |
| N | 10.00% |
| Sum: | 100.00% |

293

| Left Band | |
|---|---|
| MAJOR | 11.73% |
| PENT (upside down) | 9.57% |
| SWOR | 9.57% |
| CUPS (upside down) | 9.57% |
| WAND | 9.57% |
| MAJOR (upside down) | 11.73% |
| PENT | 9.57% |
| SWOR (upside down) | 9.57% |
| CUPS | 9.57% |
| WAND (upside down) | 9.57% |
| Sum: | 100.00% |

700

FUNCTIONAL JEWELRY

RELATED APPLICATIONS

The present patent document claims the benefit of the filing date under 35 U.S.C. §119(e) of Provisional U.S. Patent Application Ser. No. 61/792,974, filed Mar. 15, 2013, which is hereby incorporated by reference.

BACKGROUND OF THE INVENTION

1. Field of the Invention

The present disclosure relates generally to functional jewelry, and more particularly, to functional rings that may be used for entertainment purposes such as playing games.

2. Description of Related Art

A variety of tools are used for entertainment purposes such as dice, decks of cards, or other gaming pieces. However, such tools can sometimes be problematic. For example, dice may roll off a table or knock other game pieces around. A deck of cards may be ruined if something spills on them or alternatively, if one card is marked in some way. Dice are also frequently used to keep track of a number or tally. For example, for tracking health during a game by leaving the dice on a table with the appropriate number pointing up. Unfortunately, the dice can be bumped or otherwise moved, causing the player to lose the value.

BRIEF SUMMARY OF THE INVENTION

In accordance with the present disclosure, functional rings that may be used for entertainment purposes such as gaming, and methods for creating them are illustrated and described herein.

In one example of a functional ring, dice or other random result generators may be replaced with dice rings. Dice rings are designed in a way that one or multiple outer thinner ring(s) spin in a grooved inner ring that slips onto a finger. The outer smaller ring may have numbers, characters, symbols or words distributed around the ring such that when spun, a random result is produced, designated by an indicator marking on the sides of the grooved inner ring.

In another example of a functional ring, a clicking ring is disclosed. Clicking rings may be used to keep track of a combination of numbers, symbols, words, etc, instead of producing random results. The combination may be held in place by a tension-providing element such as a spring, so that even if the ring is jostled, the combination is not lost.

A method of creating a random result-generating ring such as a dice ring is also disclosed.

It should be noted that this disclosure should not be limited to rings. For example, a ring described in this disclosure may be placed beneath figurines during board games or placed on a pole or other structure. Other embodiments such as bracelets or a standalone tabletop device, for example are also possible using the concepts enclosed herein.

BRIEF DESCRIPTION OF THE FIGURES (NON-LIMITING EMBODIMENTS OF THE DISCLOSURE)

FIG. 2G illustrates sample patterns of dice rings with uneven probability distributions;

Figure 4A:
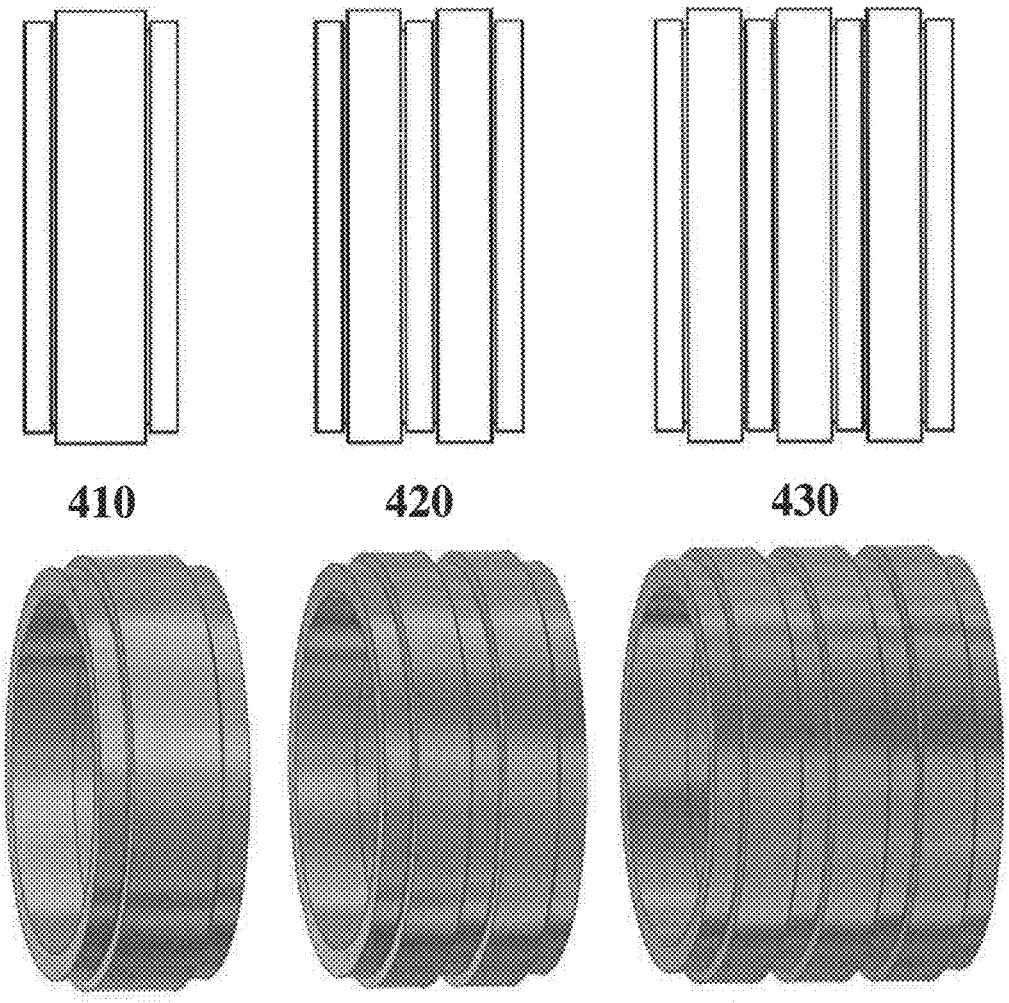
Figure 4B:
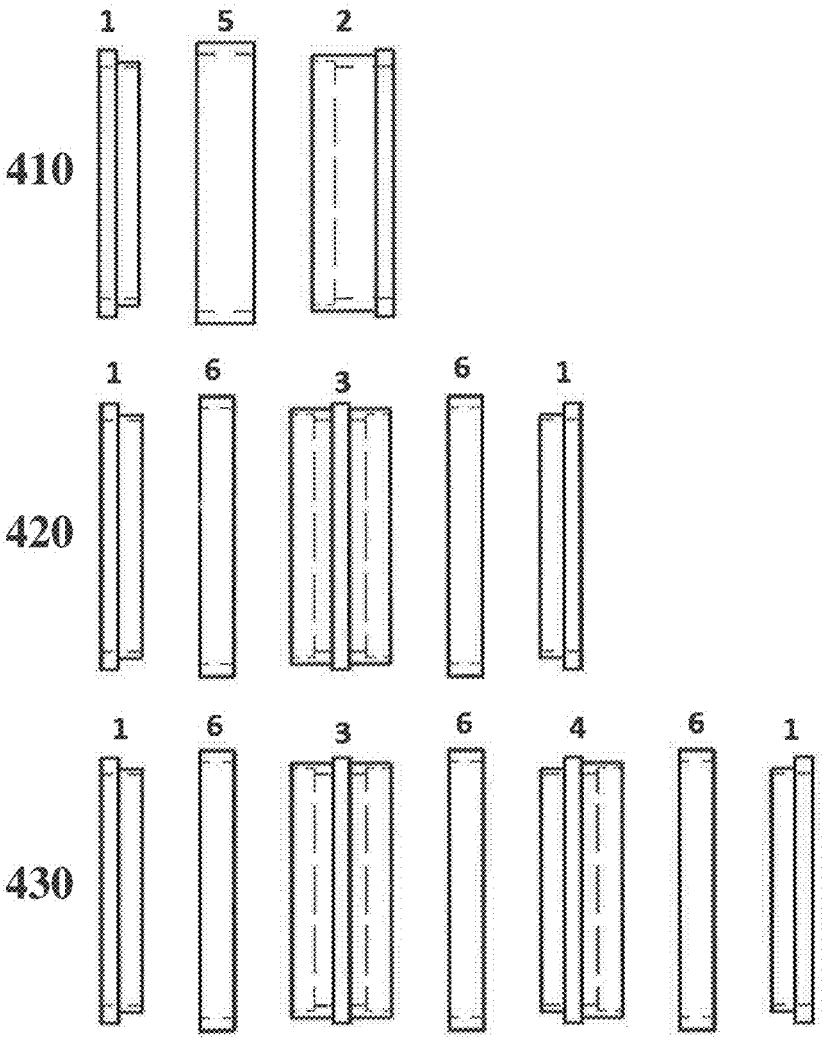
Figure 4C:
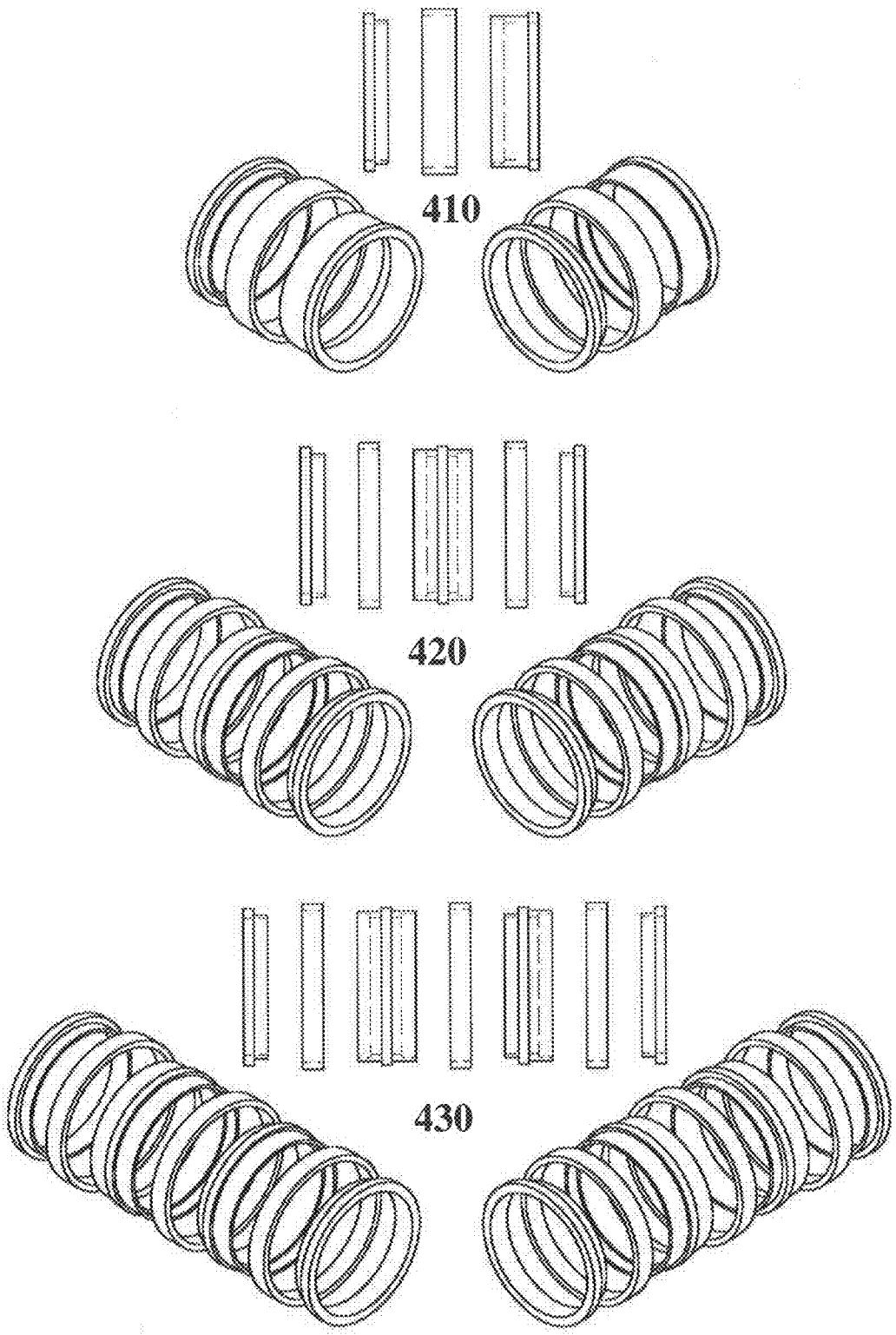
Figure 4D:
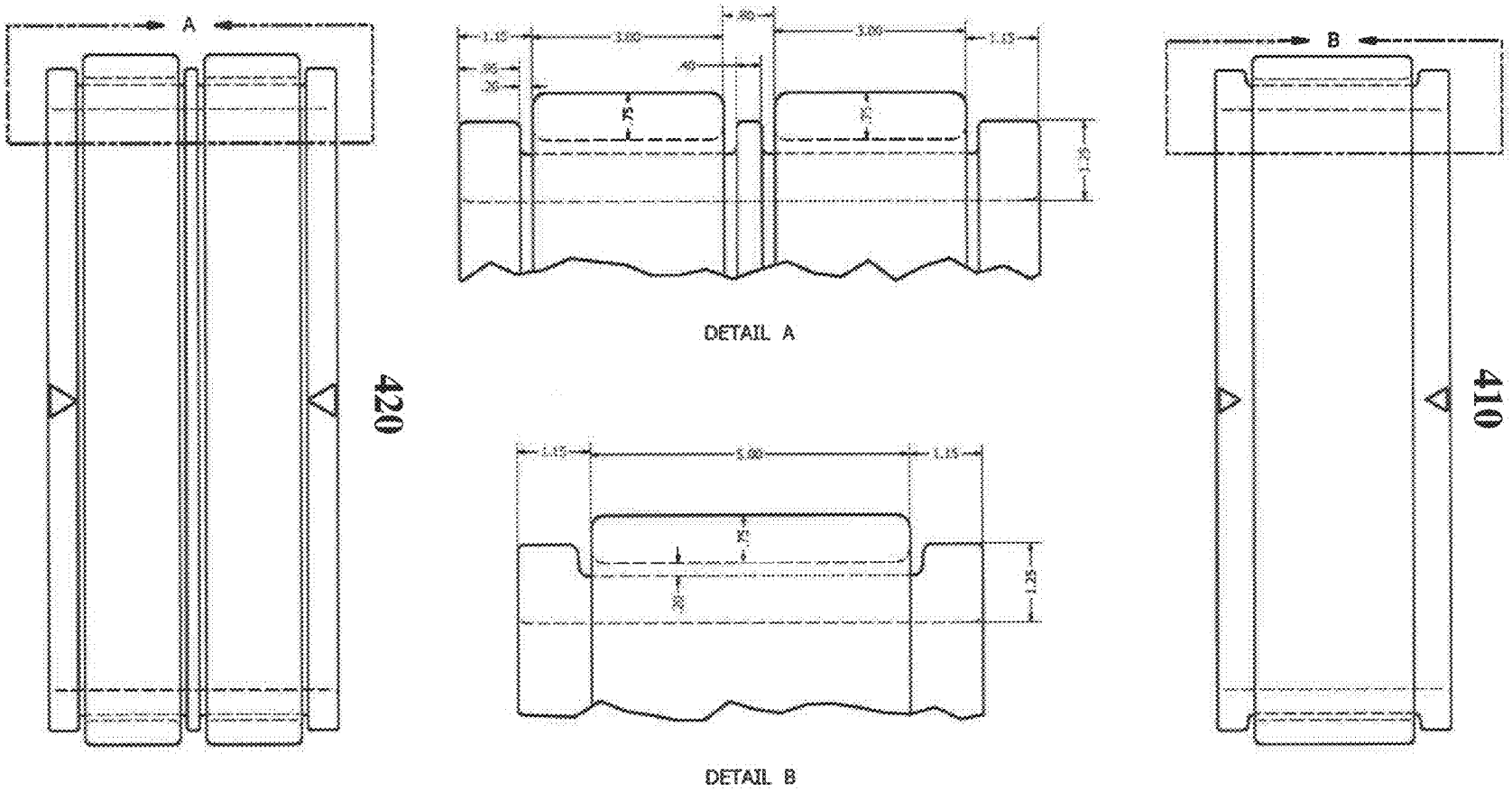
Figure 5:
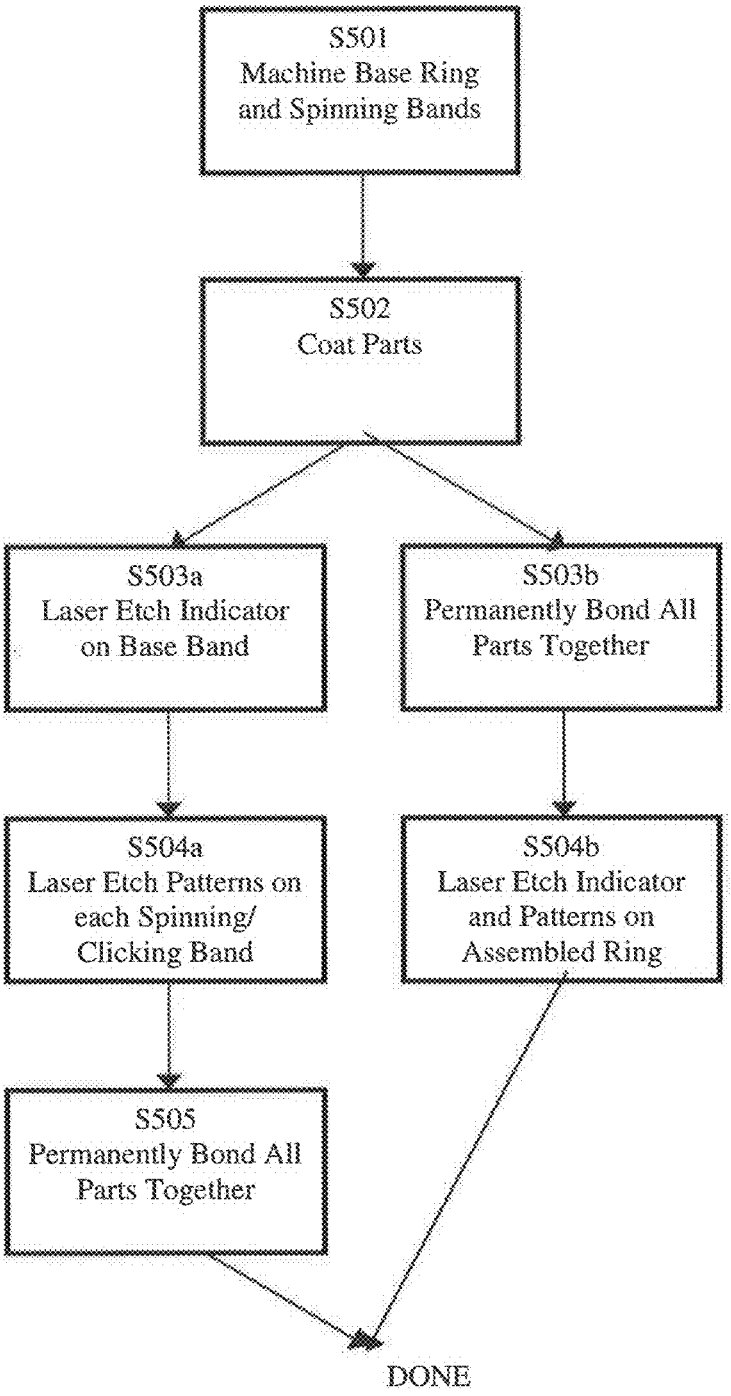
Figure 6A:
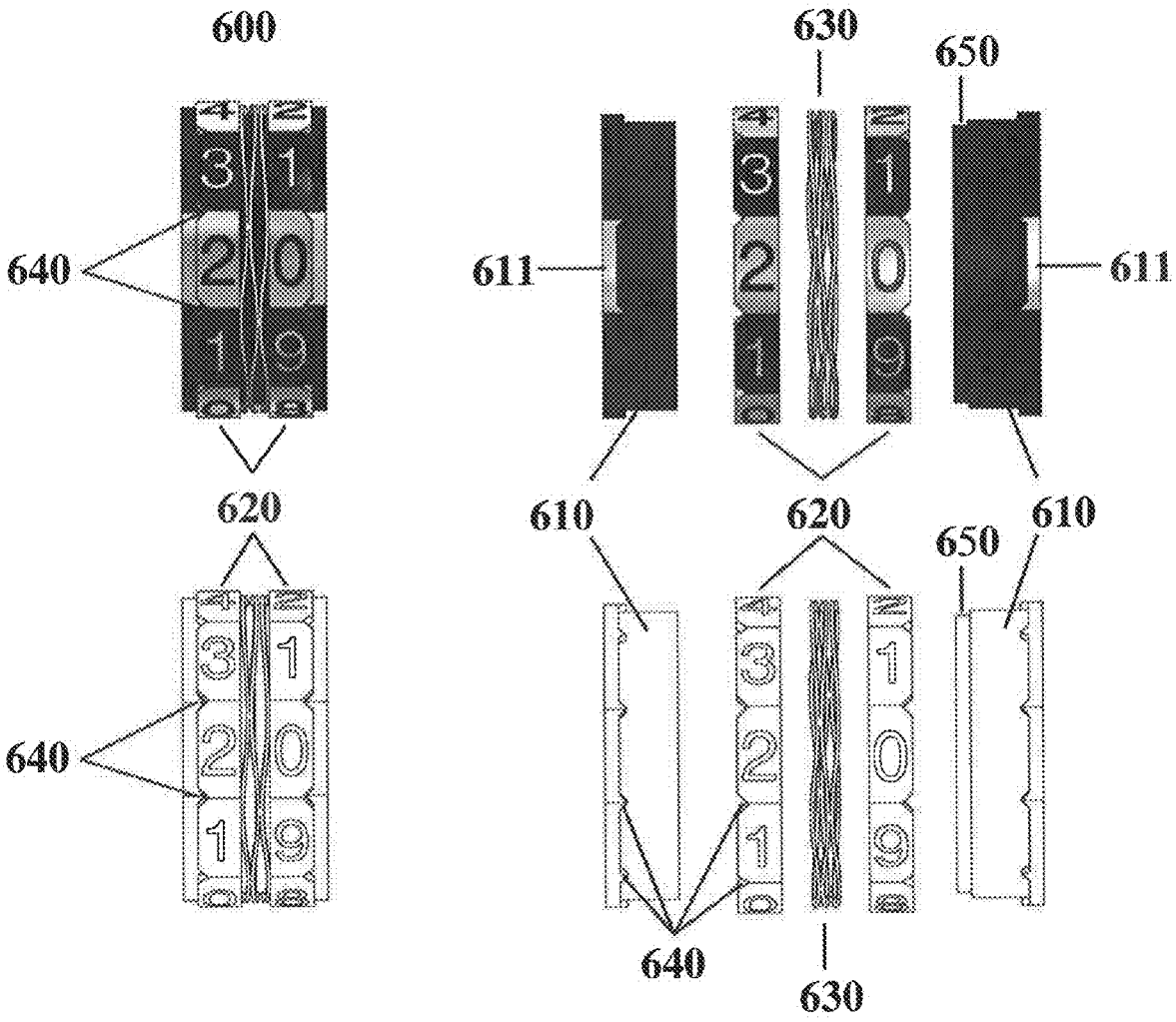
Figure 6B:
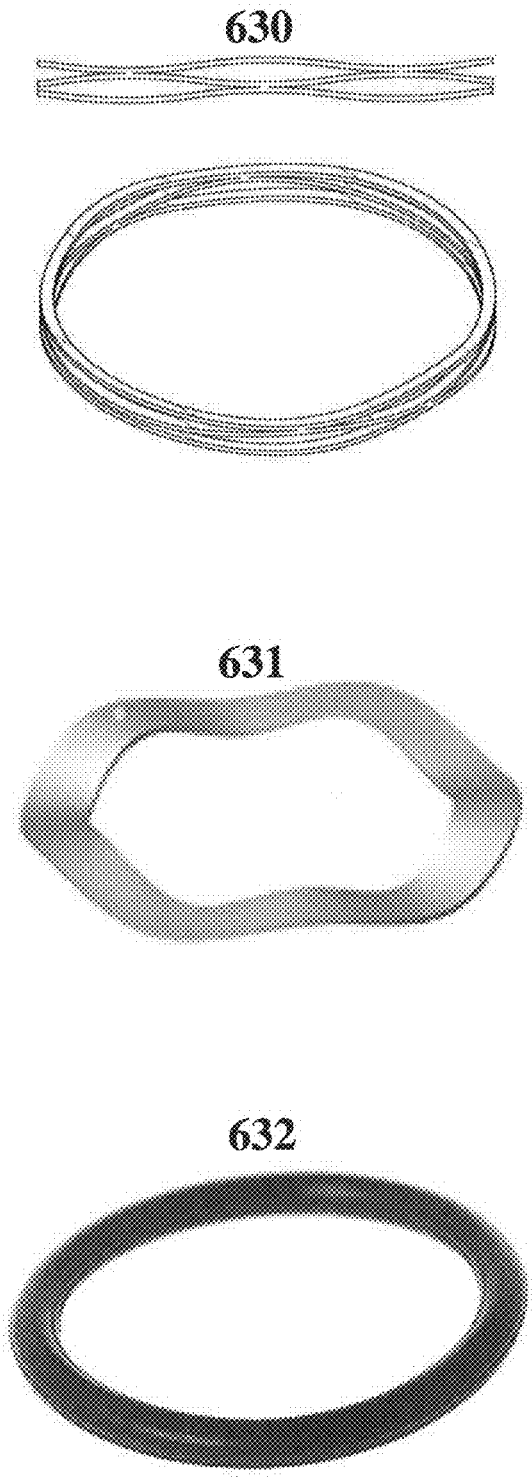
Figure 6C:
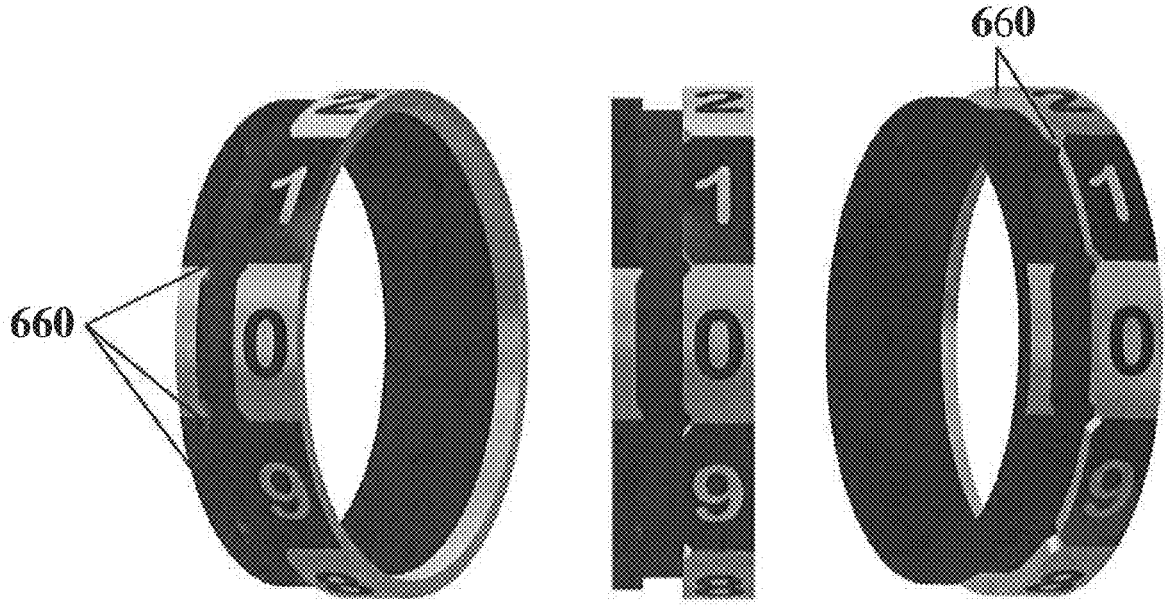
Figure 7A:
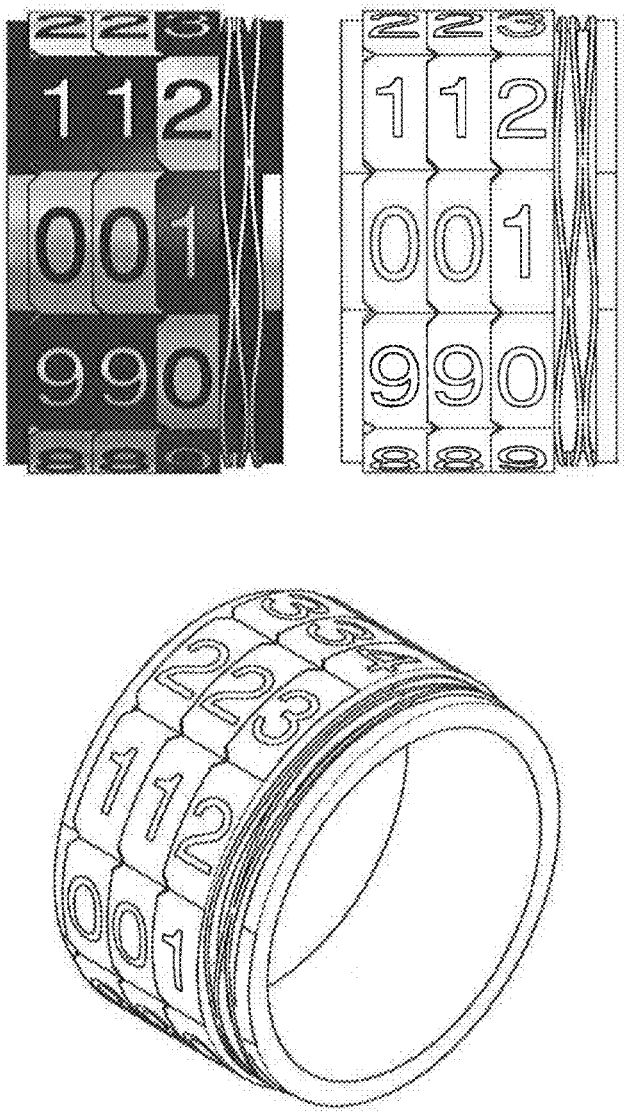
Figure 7B:
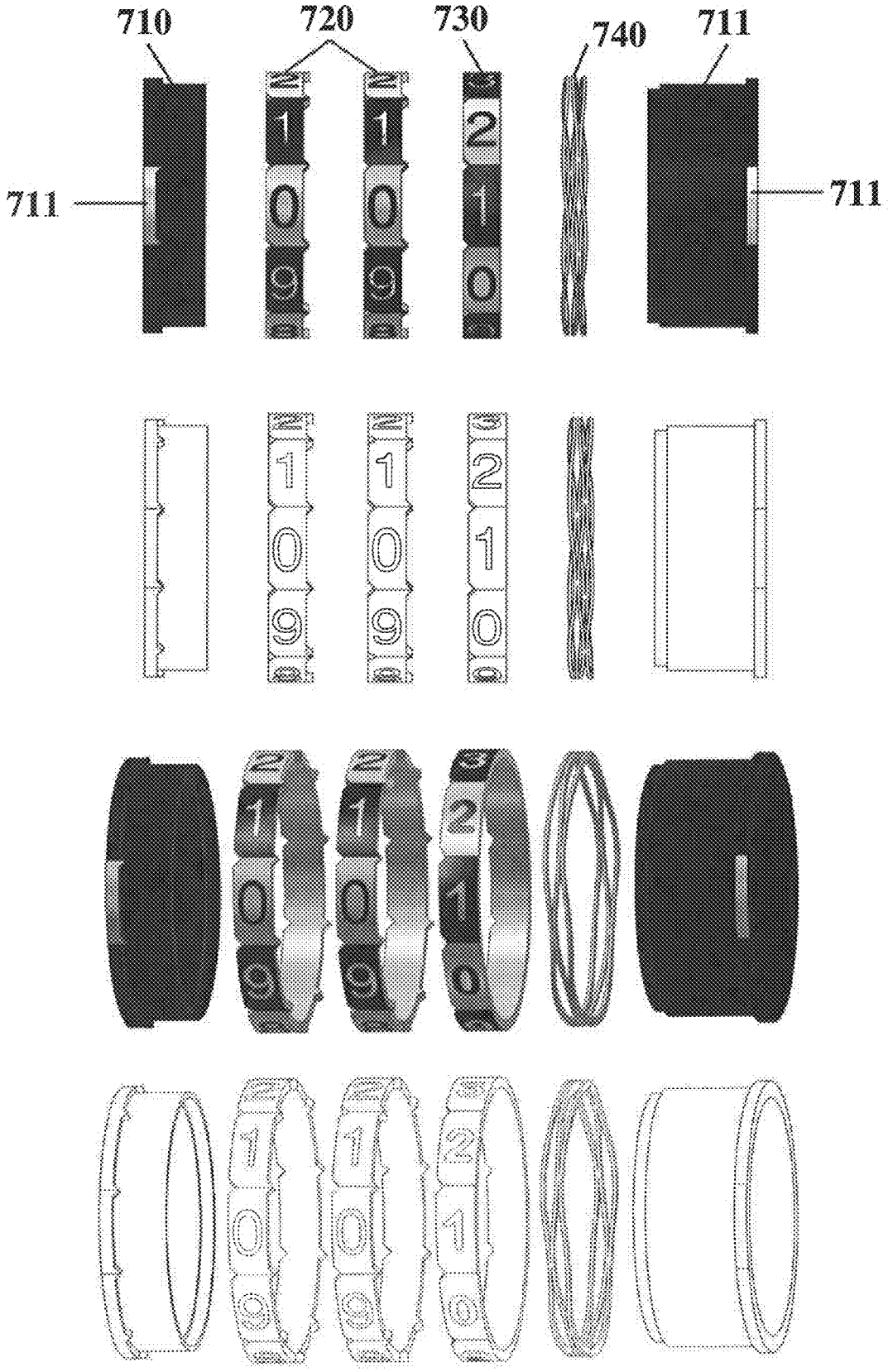
Figure 7C:
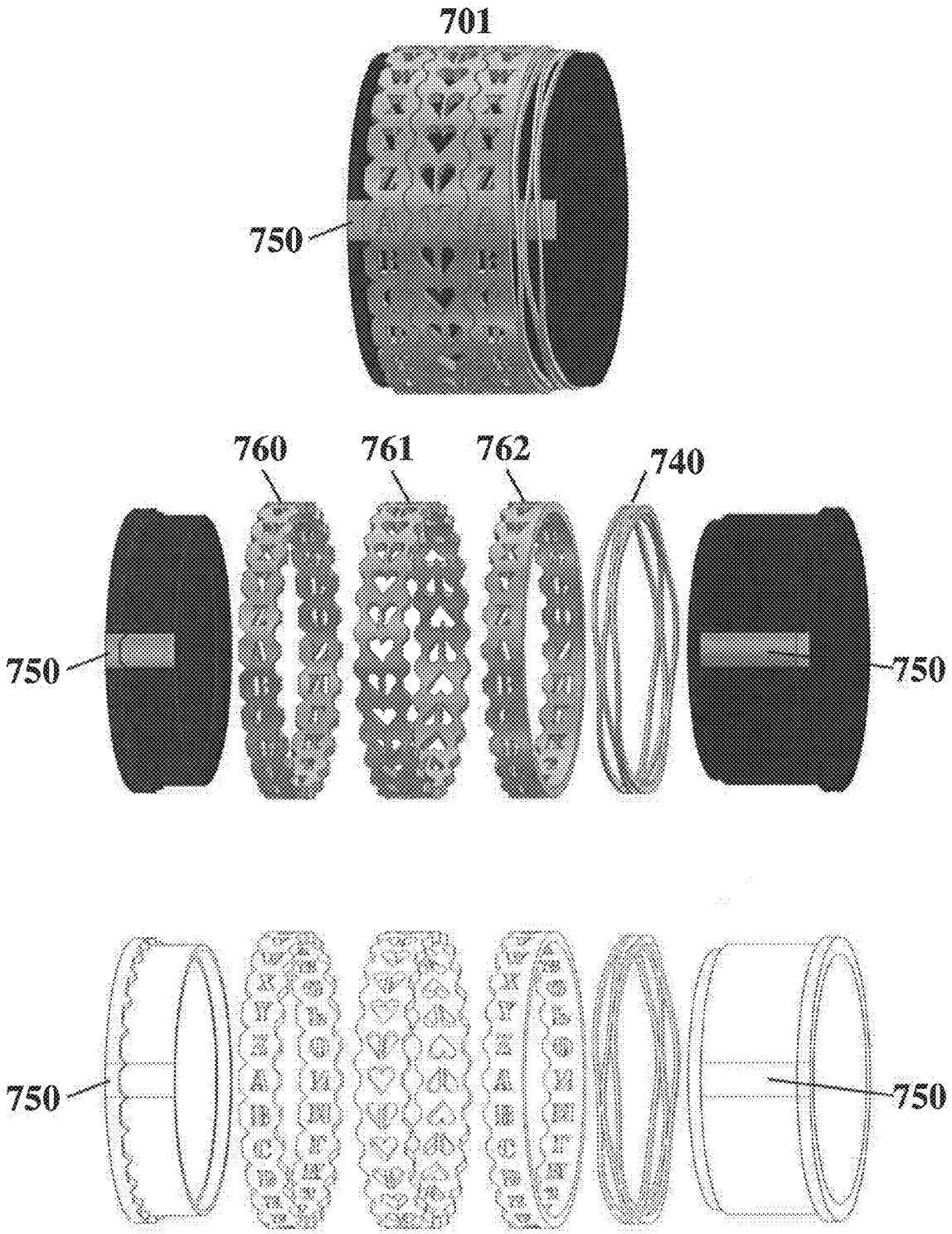
Figure 7D:
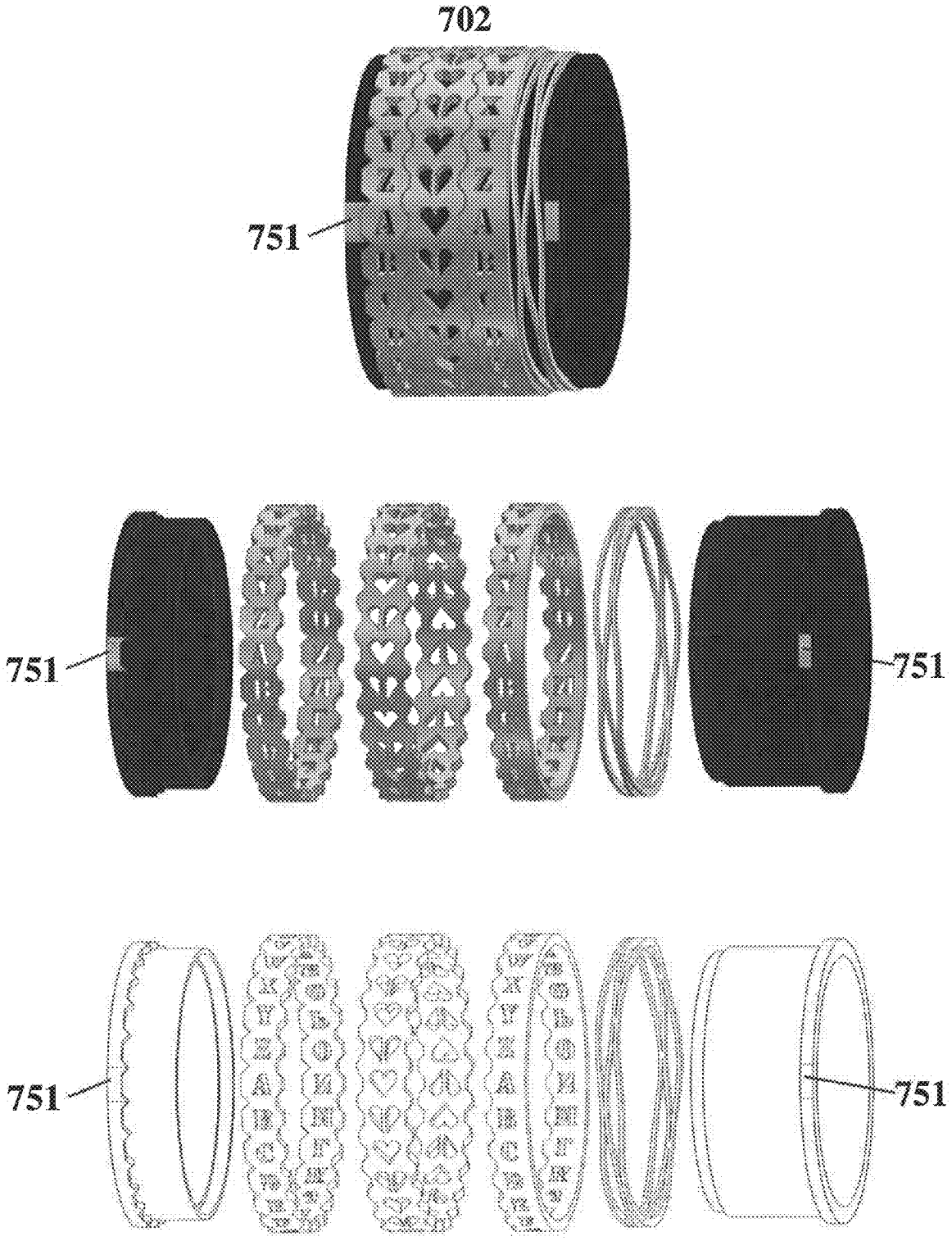
Figure 8:
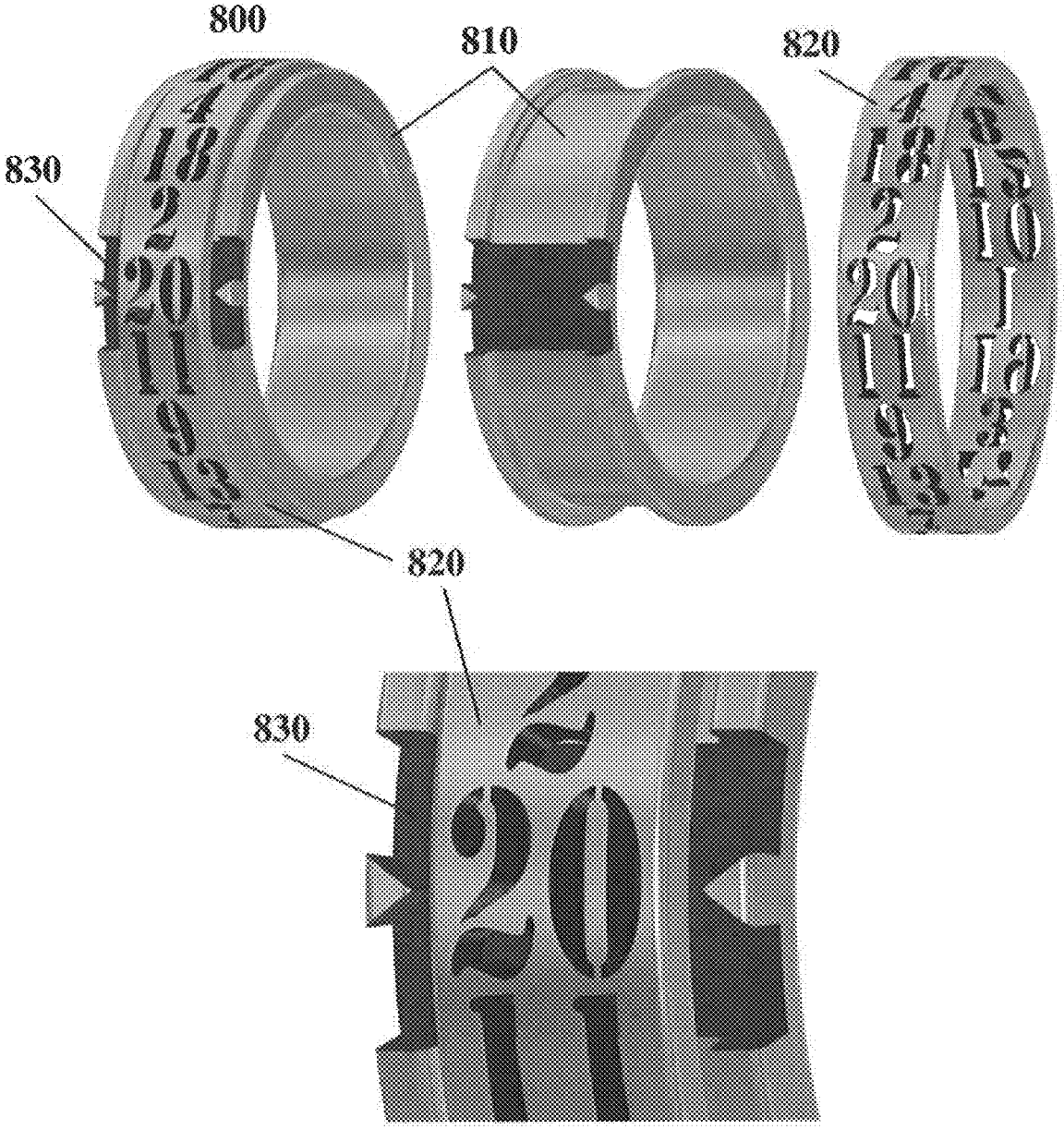

FIGS. 4A-C illustrate both sectional and isometric views of components that can be combined to create single-band, double-band, and triple-band dice rings;

FIG. 4D illustrates detailed isometric views of dice rings;

FIG. 5 illustrates a process flowchart of one method of creating dice rings;

FIG. 6A illustrates a variety of views of one example of a double-band click ring;

FIG. 6B illustrates a variety of tension providing elements that can be used to provide tension in a click ring;

FIG. 6C illustrates a clicking ring with an alternative rounded design to the notches;

FIG. 7A illustrates a variety of views of one example of a triple-band clicking ring;

FIG. 7B illustrates both sectional and isometric views of a triple-band clicking ring;

FIGS. 7C-D illustrate views of two variations of a clicking ring with different indicator markings; and FIG. 8 illustrates a dice ring with a carved pattern and carved indicator area with protruding arrow.

DETAILED DESCRIPTION

Reference will now be made to the accompanying drawings, which form a part hereof, and which show, by way of illustration, specific exemplary embodiments. The principles described herein may, however, be embodied in many different forms. The components in the figures are not necessarily to scale, emphasis instead being placed upon illustrating the principles of the invention. Moreover, in the figures, like referenced numerals may be placed to designate corresponding parts throughout the different views.

Dice Rings can be used for the generation of random results, like dice in dice-based games. Numbers, symbols, characters, words, or combinations thereof (from here on out referred to as "faces") may be distributed in a "pattern" on spinning band(s) around a base ring such that when spun, a random result is produced. One indicator mark or two or more aligned indicator marks on the base ring, which show to the side(s) of the spinning band, indicate which face is the result. In another example, the indicator could be marked on the base ring underneath the spinning band, such that if the spinning band pattern is carved out, the indicator is visible underneath. The groove that the outer band fits into should be machined or otherwise made smooth, and requires no lubricants or bearings. However a dice ring could be made with bearings and/or use lubricant(s), and may still effectively function as a dice ring. After being spun, the outer spinning band gradually comes to rest on its own due to friction, even with bearings and/or lubricant(s). The inside of the spinning bands and the groove they rest in may all be machined into reasonably precise circles to prevent potential imperfections in the circles from catching on each other during rotation. In one embodiment, the mass of the outer spinning band should be made symmetric about the axial center of the inner circular surface of the spinning band. The pattern on the spinning band may take advantage of the fact that any point on the outside of the spinning band should be just as likely to stop between the indicators as any other point. The surface area of each face in a pattern can be adjusted to match a specific desired probability distribution curve. For example, if a specific face should have a higher chance of being the result, it should be given more surface area compared to other faces in proportion to the probability. Some example patterns with uneven probability distributions can be found in FIG. 2G.

Dice Rings may be made from a variety of different materials. In one example, 316L stainless steel is used as material. In a preferred embodiment, the material used should be strong and durable to help avoid scratches, dents, changes to the shape of any of its constituent parts, etc. Dice rings can come in a variety of styles to represent many common dice and other random result generators, from r4 (a four-sided dice) to r20 (20-sided dice) to r100 (double 10-sided bands to represent each decimal digit) to unorthodox ones (for example, dice rings that represent drawing a random playing card from a standard 54 card deck). To increase the chance of fair rolls even when the rings are spun lightly and may not turn a full revolution, the faces are mixed up and distributed across the band such that there's no concentration of high or low numbers in succession. This decreases a person's ability to control the outcome of a spin by applying more or less force to the spin. This also appears more random at first glance. Although if a spin causes several revolutions in the spinning band(s), it would likely be nearly impossible to predict the results.

Dice rings may be designed in a variety of ring sizes and colors. Various methods may be used to produce different colored or textured dice rings and clicking rings. One goal being for aesthetic purposes. Another, to be able to discern a contrast between different faces. For steel, the rings may be coated through Pressurized Vapor Deposition (PVD), which changes the surface of the steel to color the rings black, blue, gold, rose-gold, and coffee, among others. If, for example, all or any part of the rings were made from titanium, they could be anodized black or any other color(s), or black with colored surfaces within the black.

The faces may be made by coloring the entire ring, and then using lasering, etching, carving, coating with a different color, or any other process to distinguish/contrast the characteristics and boundaries of the faces. Alternating the background color of the faces, or putting a line between faces are two ways to distinguish the faces from each other. Laser etching is one very effective way to mark the faces of a spinning band because it removes a very minimal amount of mass from the surface of the ring, and that amount is removed evenly from around the entire spinning band, helping keep the ring's center of mass aligned with the axis of rotation.

Figure 1:
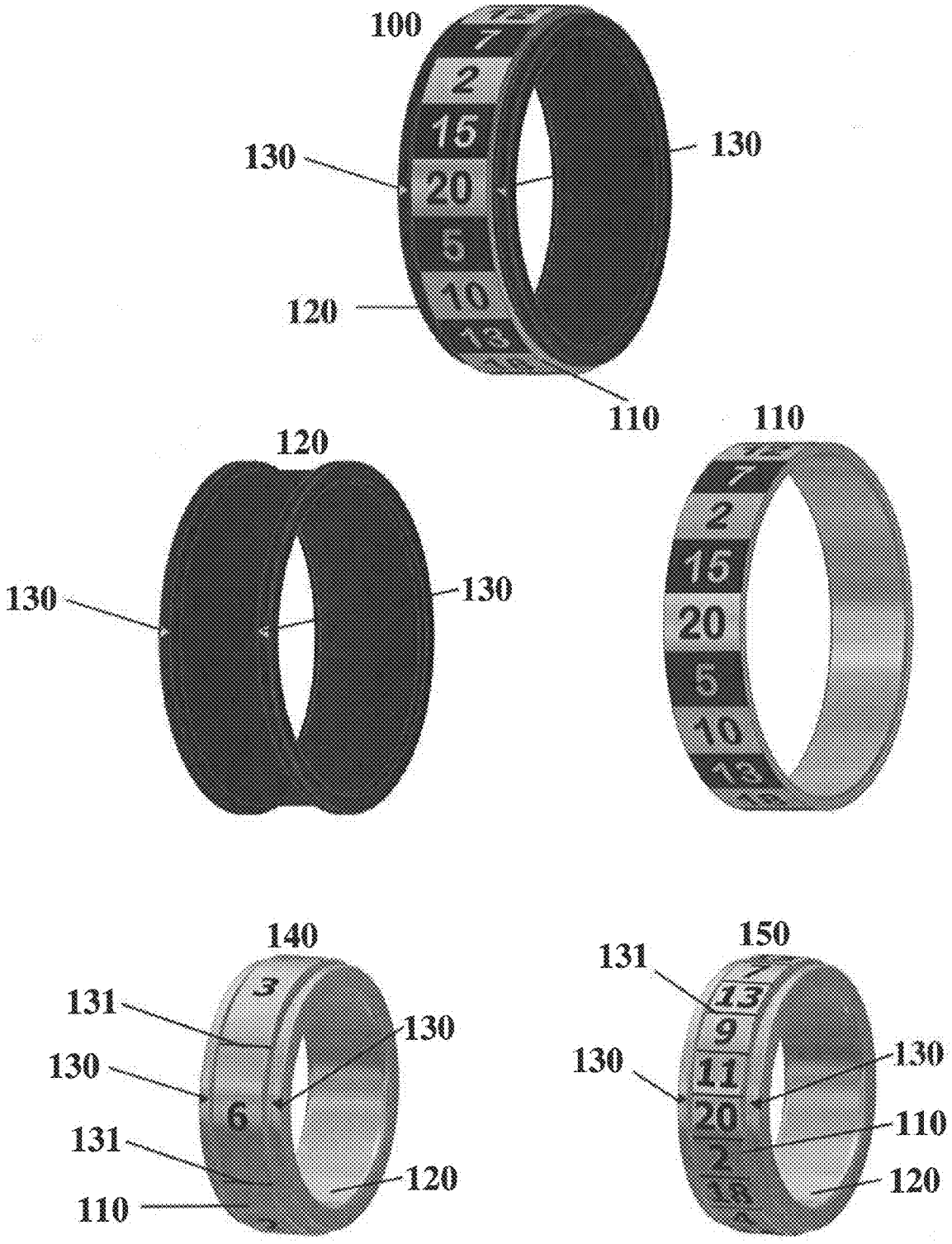
FIG. 1 illustrates examples of embodiments of dice rings.

Referring now to FIG. 1, exemplary embodiment dice rings are illustrated. Dice ring 100 includes spinning band 110 and base ring 120. Dice ring 100 may be used, for example, in place of a 20 sided die. Faces on dice ring 100 are laser etched around the spinning band 110.

Base ring 120 is the encompassing structure of the ring that touches/grips the finger worn on. Spinning band 110 is the structure that fits into the groove(s) of the base ring.

On spinning band 110, the numbers/faces 1-20 (12, 7, 2, 15, 20, 5, 10, 13, and 18 shown) are evenly distributed around the ring so that when spinning band 110 is spun, each face has an equal chance of coming to a stop in between the arrows. Instead of rolling a 20 sided die, a player may spin the spinning band 110 of dice ring 100.

Dice rings 140 and 150 incorporate dividing lines 131 between the faces for contrast instead of alternating the backgrounds of faces in the pattern.

Indicators 130 may be lasered, etched, carved, painted, or otherwise marked on base ring 120. Indicators 130 are used to show/indicate the results of a spin. In a preferred embodiment, indicator(s) 130 should stand out and be aligned to each other. In FIG. 1, indicators 130 are exemplified by arrows. However, any symbol or marking may be used as an indicator. Here, indicators 130 on dice ring 100 show that the number 20 is the result of the spin. The spinning band could technically come to a stop such that the arrows point to a line between faces. In this situation, it would be custom to assume it landed on the number above the line.

Figure 2A:
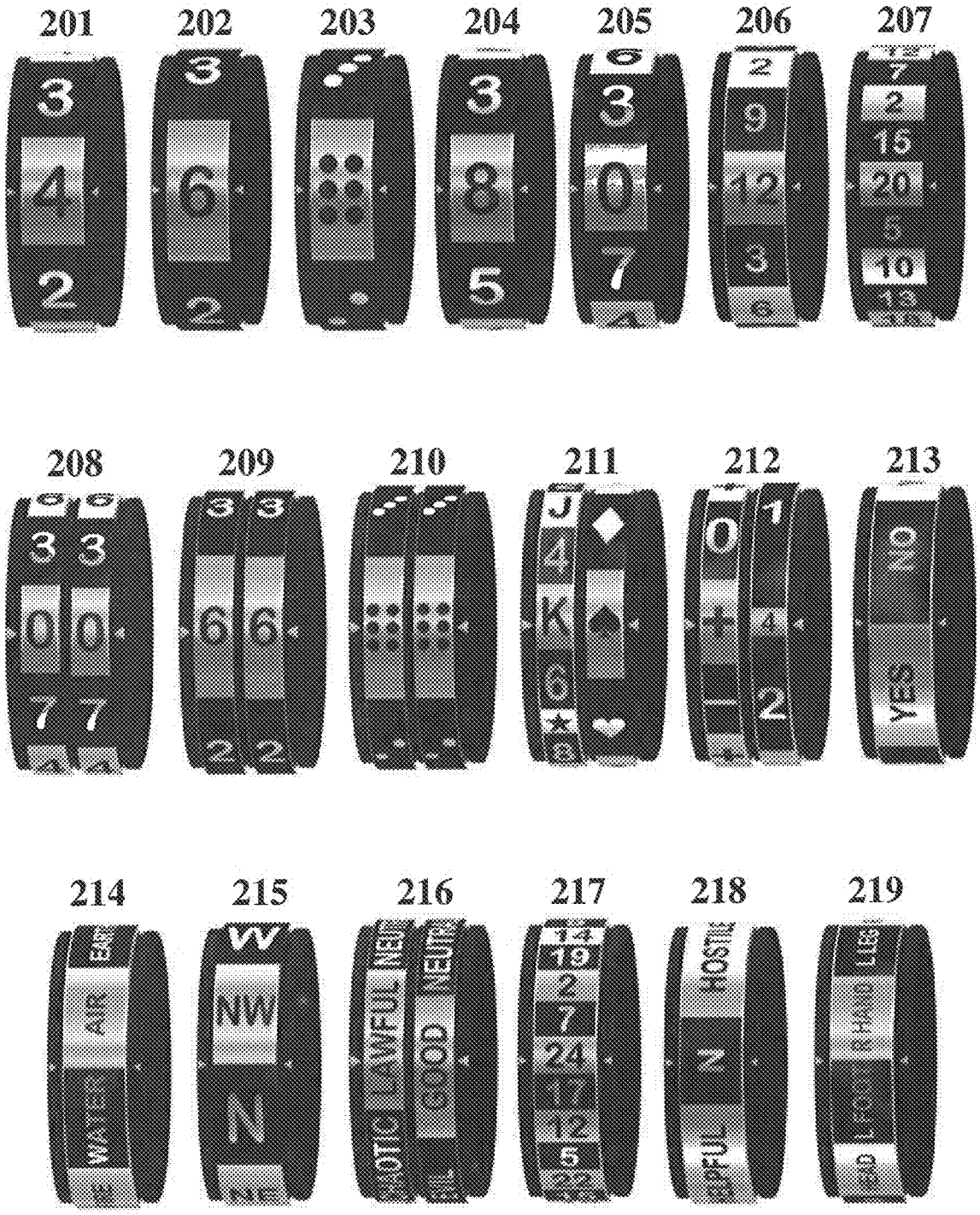
FIGS. 2A-2B illustrate additional embodiments of dice rings.
Figure 2B:
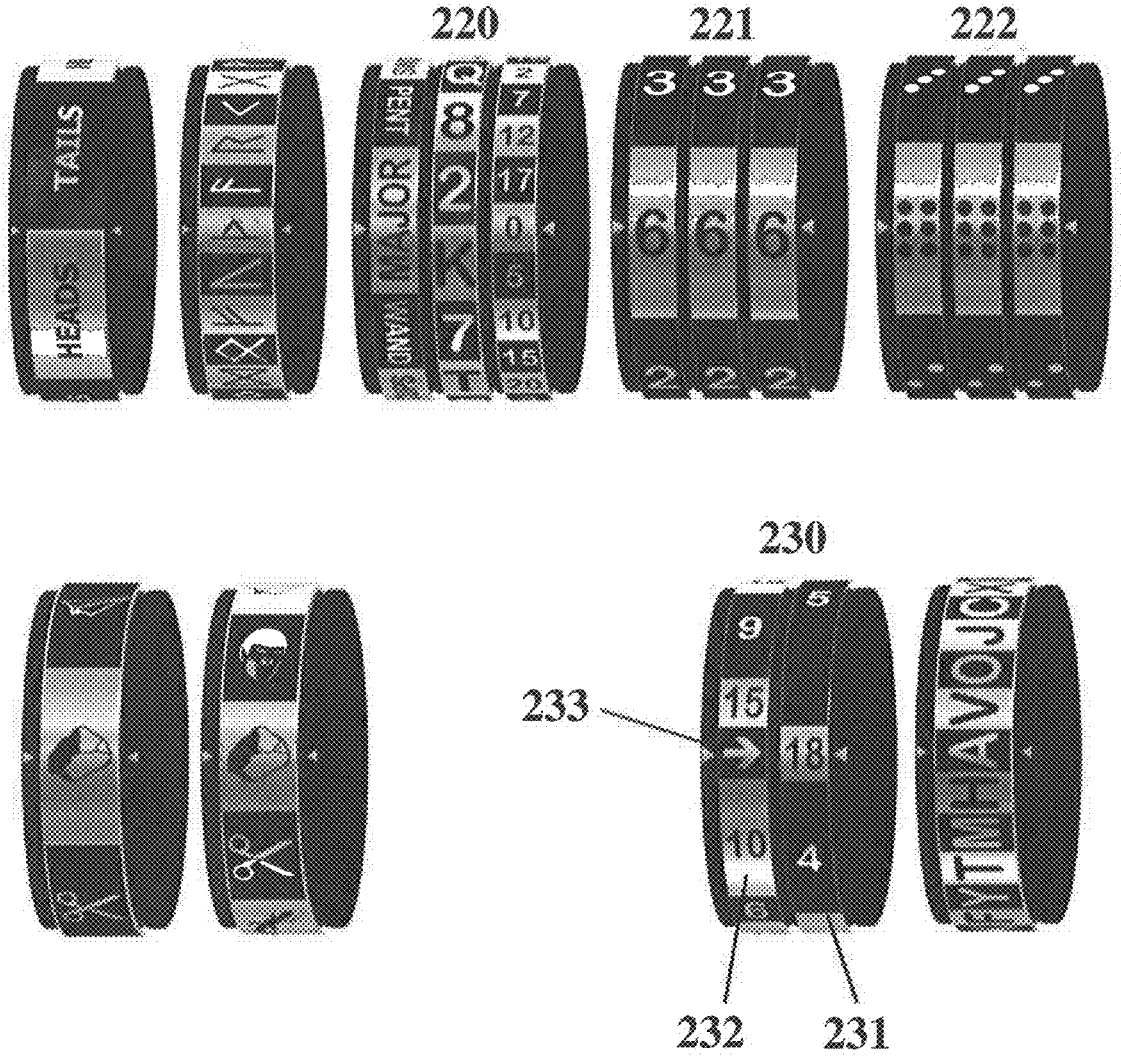

While there may be an infinite number of possible designs for dice rings, FIG. 2A-2B illustrate perspective views of additional exemplary embodiments of dice rings. Referring to FIG. 2A, Dice rings 201, 202, 203, 204, 205, 206, 207, 213, 214, 215, 217, 218, and 219 are all single band dice rings. Dice rings 208-212 and 216 are double band dice rings. Dice rings 220, 221 and 222 in FIG. 2B represent three band dice rings.

In the case of multi-band dice rings, patterns here are grouped together, but separated by gray space. Notationally, dice rings may be referenced using standard dice notation combinations except that the "d" is replaced with an "r." For example, an r4 dice ring may be used in place of a 4 sided die, commonly referred to as a d4.

Figure 3A:
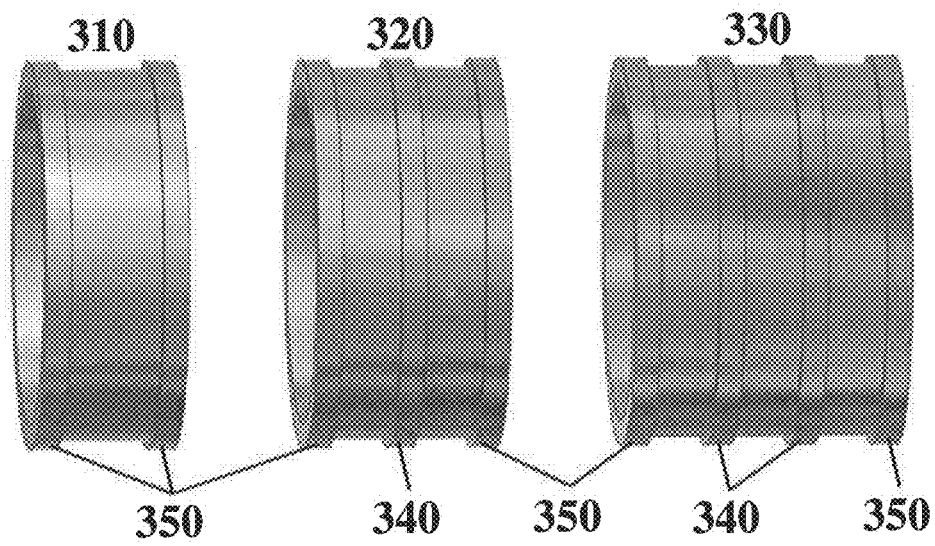
FIG. 3A is one view of a single-band base ring, double-band base ring, and triple-band base ring without the spinning bands, made as a single part each.
Figure 3B:
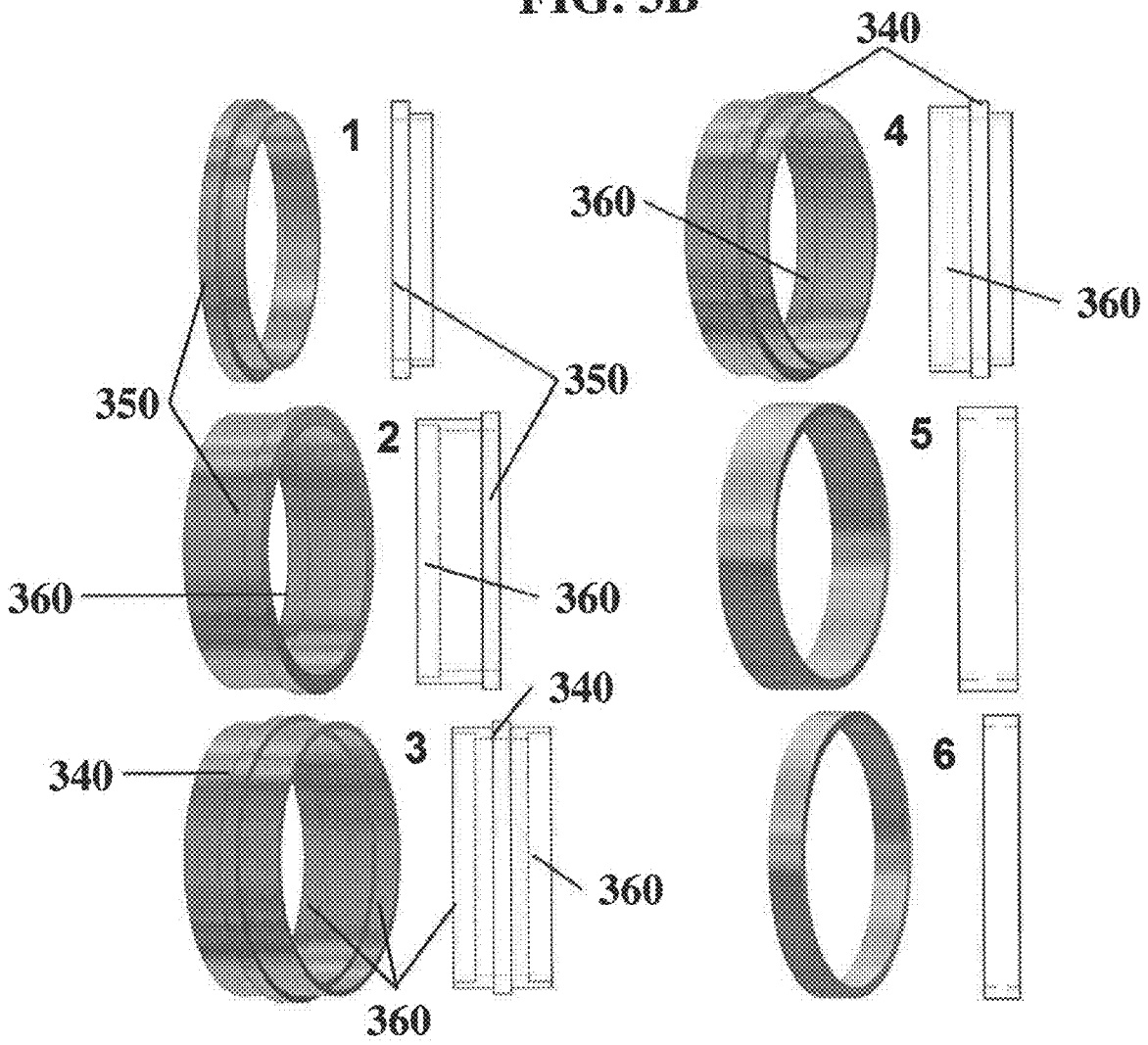
FIG. 3B illustrates both isometric and sectional views of components that can be combined to make dice rings with any number of bands.

Each spinning band in a multi spinning band dice ring may have its own track or path to prevent them from rubbing against each other or affecting each other's outcome. In a preferred embodiment, dice rings that have two or more spinning bands may have a physical divider between them. A physical divider, as shown in FIG. 3A-B, creates two distinct grooves for each spinning band and prevents the spinning bands from rubbing against each other or sticking to each other, which may bias how both rings would land.

Sometimes the results of dice (or any other random number/symbol/word generators) do not have outcomes with a perfectly equal probability. Referring to FIG. 2A, full pattern shown in FIG. 2E, the dice rings 211 and 212 exemplify adjusted surface area to match a probability distribution curve. For example, in the dice ring 211 (representing a deck of cards) embodiment, it is shown that that the surface area of the suit (here, spades), is much greater than the surface area of number and face cards (here, King) because while there are 13 cards per suit in a standard 52 card deck, there are only four suits. Additionally, in the cards example, the star, representing a joker, is adjusted to encompass half the surface area of the numbers or face cards because there are two jokers in a deck of cards but four of every other card. For example, the odds of drawing a King would be 4 out of 54, while the chances of drawing a Joker would be 2 out of 54.

Figure 2C:
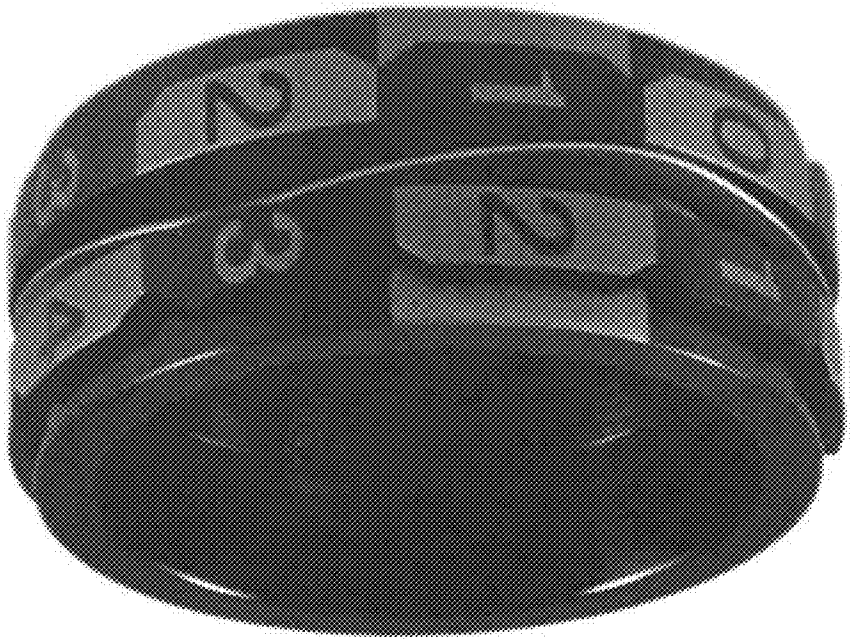
FIG. 2C illustrates one example of a clicking ring.
Figure 2D:
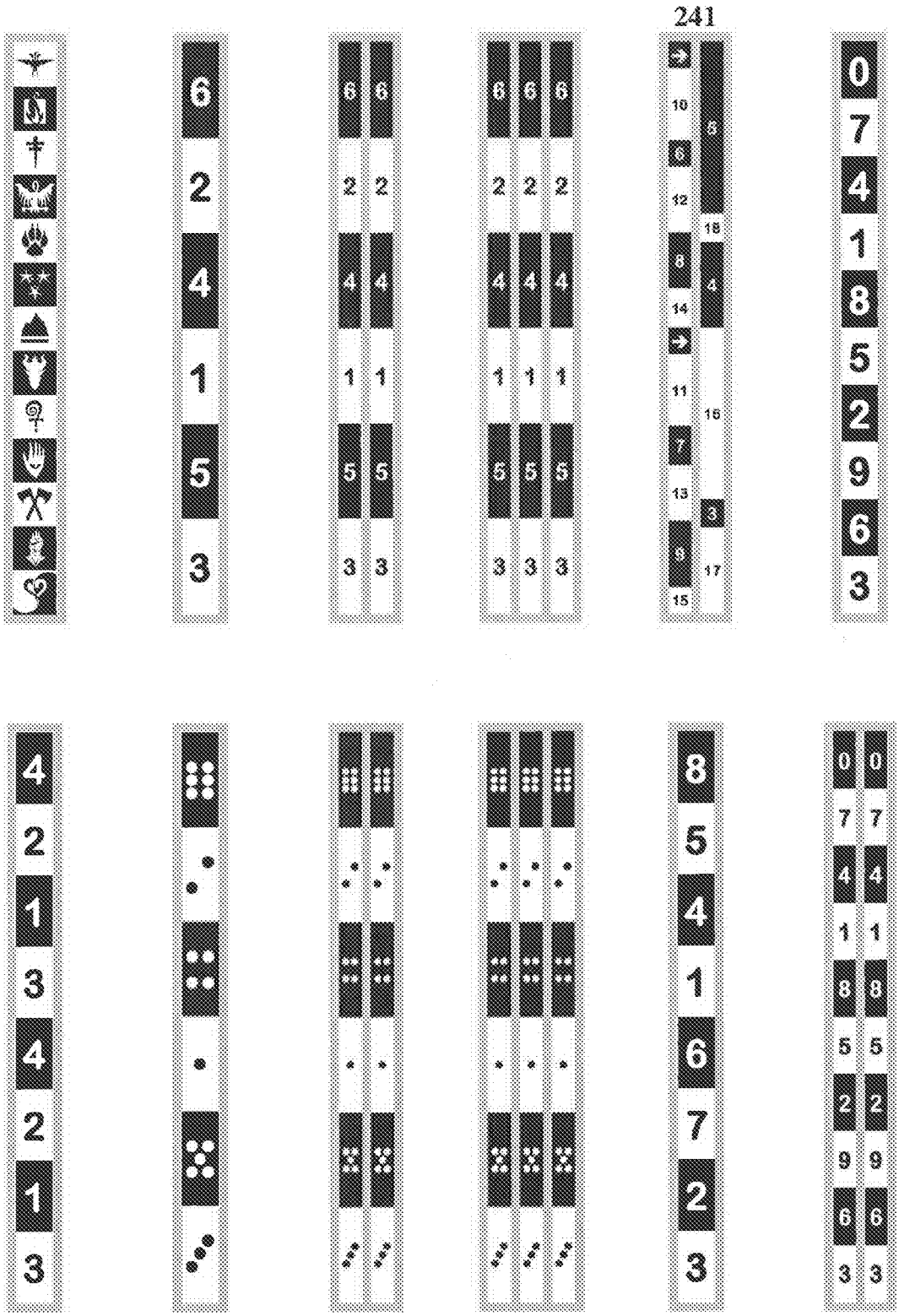
FIGS. 2D-2F illustrate various sample patterns that may be used on dice rings.
Figure 2E:
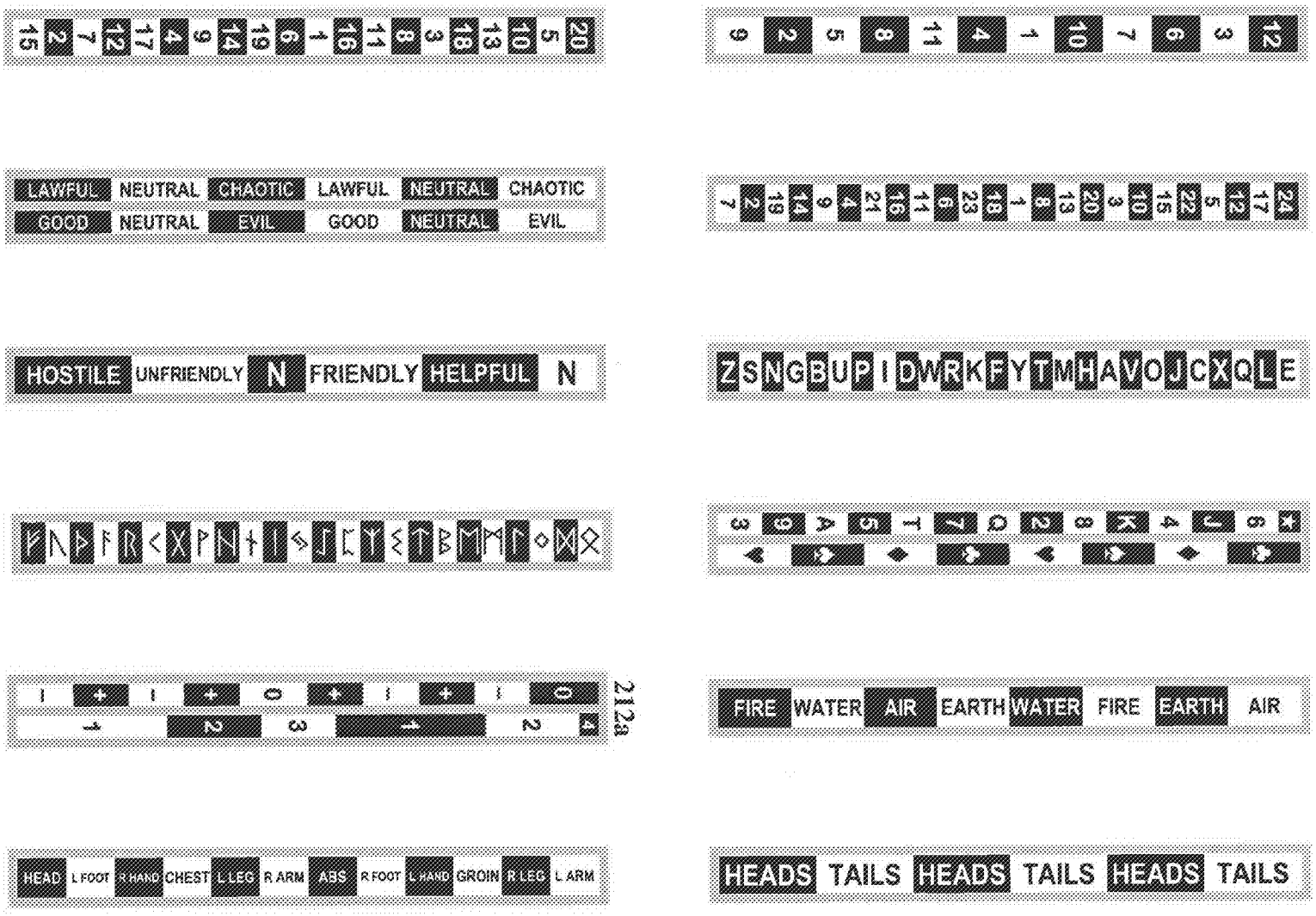
Figure 2F:
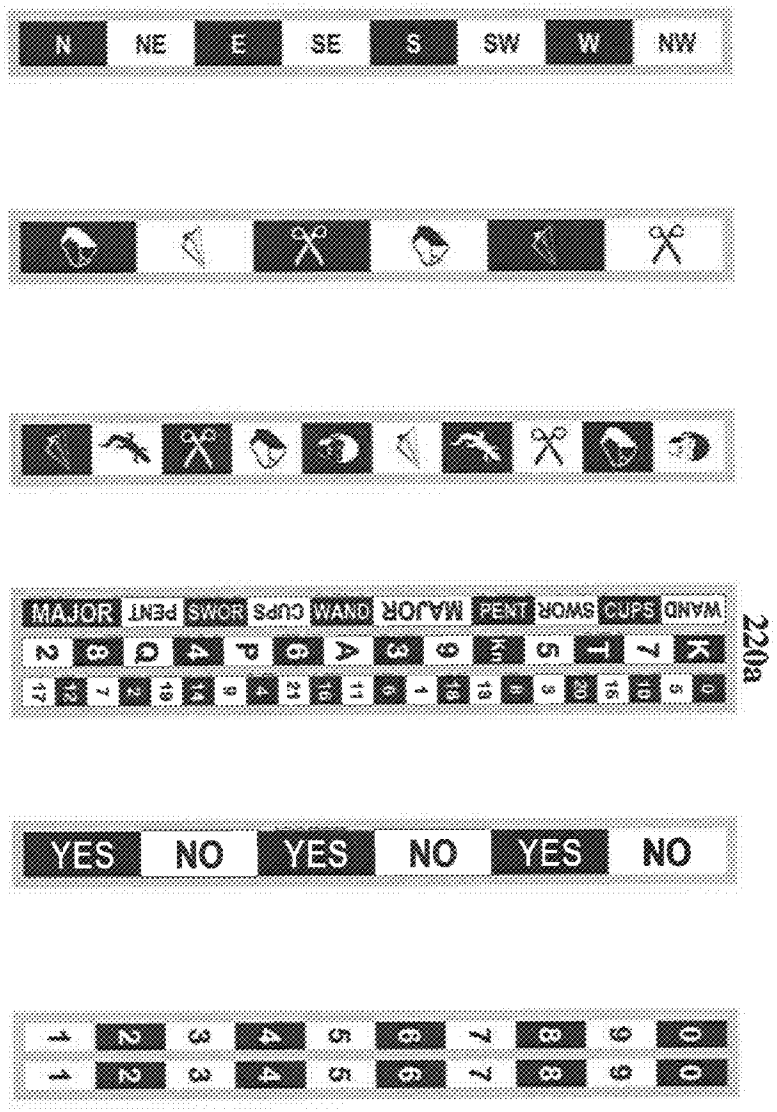

In FIG. 2B, full pattern shown in FIG. 2F, dice ring 220*a* is an example of a triple-band ring. If the left band lands on "major," one would look at the right band to determine which of the Major Arcane cards were pulled. If the "Major" has a white background, the card was drawn right side up. If the "Major" has a black background, the card was drawn up-side down. If the left band lands on one of the Tarot card suites (Wands, Cups, Swords, or Pentacles), one would look at the middle band to see which Minor Arcane card was pulled. This same background rule applies to see if the minor Arcane card was pulled right-side up or upside down. A=Ace, P=Page, Kn=Knight, Q=Queen, K=King. In this way one can accurately model the draw of a random Tarot Card from a standard Tarot deck.

In another example, rolling three 6-sided dice together for the purpose of summing the results would not have outcomes with a perfectly equal probability. Referring to FIG. 2B, dice ring 230 (pattern 241 of FIG. 2D), the faces of each number are distributed and sized to match the probability curve of getting those results that would be equivalent to rolling three 6-sided dice together for the purpose of summing the results. However, the chances of getting a 3, 4, 5, 16, 17 or 18 are so small, that they could not be accurately represented on a single spinning band ring. Some numbers would be as small as only 0.46% of the surface area of the ring, which would have an unintelligible face marker because of its size. Thus, in a space that would be the sum total size of spinning any of the numbers in that range, an arrow 233 is placed on spinning band 232. The arrow 233 points to the next spinning band 231. Spinning band 231 has those numbers, i.e. 3, 4, 5, 16, 17 or 18 proportionately sized with respect to each other. Thus, when a number is spun on spinning band 232, that number is the resulting sum and spinning band 231 should be ignored. If the arrow 233 is spun on spinning band 232, the resulting sum is displayed on spinning band 231. In this example, since the arrow was spun on spinning band 210, the resulting sum is 18.

Any probability curve for random results generated from a discrete set could be reproduced in a dice ring by adjusting the percentage of the spinning band face that the result occupies, or through a combination of small sections of one spinning band being expanded on a separate spinning band for very low probability results (for example, rolling 3, 4, 5, 16, 17, or 18 on a 3d6 roll).

FIGS. 2D-2F illustrate exemplary patterns that may be used on single-band, double-band, and triple-band dice rings. FIG. 2D illustrates exemplary patterns 240, FIG. 2E illustrates exemplary patterns 250, and FIG. 2F illustrates exemplary patterns 260.

FIG. 2G illustrates the surface area percentages of some of the patterns with uneven face probability distributions. Exemplary patterns 290, (left and right bands), 291 (left and right bands), 292, and 293 are illustrated. Symbols in left columns correspond to surface area percent in right columns. For example, spinning a "4" on the right band of pattern 290 has a probability of 3.21% while spinning a "2" has a probability of 16.14%, and so forth. The sum of all probabilities in each band equals 100%.

FIG. 3A illustrates views of a variety of base rings. In one embodiment, end lips 350 must be a certain width to be able to hold the indicator marks. The dividing ridges 340 are rectangular in these images, but any ridge shape could be used to create distinct grooves, as long as the ridges are tall enough to prevent spinning bands from hitting each other. For example, these ridges may function just as well if they had rounded or triangular peaks.

FIG. 3A includes single spinning base ring 310, double-band spinning base ring 320, and triple-band spinning base ring 330. These can be made as a single piece of material each or they can be made from constituent parts such as in FIG. 3B.

In an embodiment of a method of making a ring, if made from a single material, that material should be able to be permanently stretched outwards. In this embodiment the base ring starts out with an outer diameter small enough to fit freely inside the spinning bands, such that the ridges 340 and lips 350 also fit freely inside the spinning bands. This is so that the base ring can be permanently stretched to encompass the outer spinning bands during assembly of the base ring with its spinning bands. Alternatively, instead of stretching the base ring to encompass the spinning bands, the base ring could be cooled so that the material shrinks and the spinning band can be heated so that they expand, and then slipped into each other and brought to the same temperature to permanently combine parts.

FIG. 3B illustrates both isometric and sectional views of components/parts that can be combined/assembled to create dice rings with any number of spinning bands. Male cap (1), female cap (2), female-female extender (3), and male-female extender (4) are various components that may combine to form base rings. The male and female ends of the parts are made in such a way that they slip completely into each other.

When any two base parts (i.e. any two of 1-4) of the base ring are pushed together, they may be either welded or cemented with an adhesive, or otherwise permanently merged. One merging method may be to push together a male and female part to be bonded, and then stretch the male part from the inside while it is in position, press bonding it with the female part. Alternatively, the male part could be cooled, and the female part heated, and then they may be pushed together and returned to room temperature, bonding them. If intending to bond them in this fashion (using temperature to alter the size of the parts) the male ends of parts should be made with a slightly larger diameter than can fit in the female end. That is so they only fit together when brought to different temperatures, and then become permanently bonded when brought to the same temperature while held in the desired final positions.

Lip 360, shown in FIG. 3B, may be used so that the groove 350 doesn't get any melted metal or residue in it if the rings are combined with welding, adhesive, and/or any process where there is possible runoff of permanent material into the groove, keeping the smooth groove intact for optimal spinning.

Base rings 310, 320, and 330 are designed to produce statistically independent results on each spinning band. Grooves 340 on multi-band rings keep the spinning bands from touching each other and affecting each other's outcomes. Base rings 310, 320, and 330 either have ridges between the bands, separate and/or distinctive grooves for each spinning band, or other means to ensure that spinning bands in multi-band rings do not touch or otherwise affect each other.

Figure 3C:
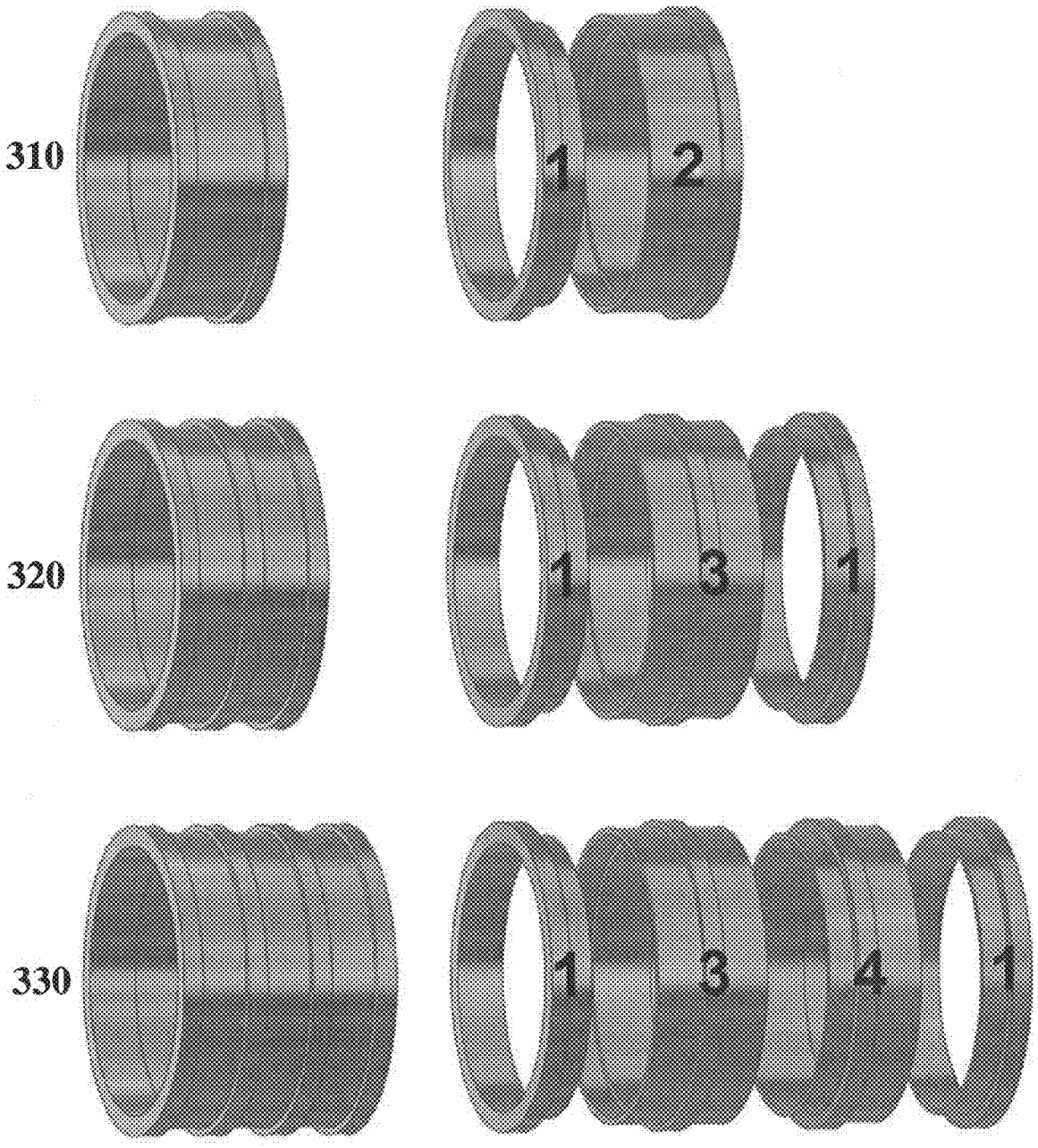
FIG. 3C illustrates isometric views of base bands and base band components.

FIG. 3C represents isometric views of male cap (1), female cap (2), female-female extender (3), and male-female extender (4), joined together to produce base rings 310, 320, and 330. Thus, one could combine parts from FIG. 3B to create a single-band base ring 310, double-band base ring 320, and triple-band base ring 330 without the spinning bands.

FIG. 4A represents isometric and sectional views of single-band dice ring 410, double-band dice ring 420, and triple-band dice ring 430. One could combine parts from FIG. 3B to create single-band dice ring 410, double-band dice ring 420, and triple-band dice ring 430.

FIG. 4B is an isometric view of single-band dice ring 410, double-band dice ring 420, and triple-band dice ring 430. Single-band dice ring 410 includes male cap (1), spinning band (5), and female cap (2). Double-band dice ring 420 includes male caps (1), two spinning bands (6) and a female-female adapter (3). Triple-band dice ring 430 includes two male caps (1), three spinning bands (6), female-female adapter (3), and a female-male adapter (4).

Spinning band 5 may be used for a single-band dice ring 410. Spinning band 6 may be used as the spinning band for multi-band dice rings 420 and 430. Spinning band 6 is thinner so that the overall sizes of multi-band rings are closer to single-band dice rings. This produces a more attractive ring, and keeps them closer to each other in size, but this is not a design necessity. The spinning bands can be any width, even different widths mixed within a single ring. Differences in the width of spinning bands have little effect on the probability of its outcomes. A wider ring will have more mass and more momentum, but that only makes the ring spin longer when given the same initial speed. This does not affect the probability of resulting faces.

FIG. 4D illustrates detailed isometric views of single spinning dice ring 410 and double spinning dice ring 420. Detail A shows an exploded view of the top portion of double-band spinning dice ring 420 with example proportions showing. Detail B shows an exploded view of the top portion of a single-band spinning dice ring 410 with example proportions showing.

FIG. 5 illustrates a process flowchart of one method of creating a dice ring. This method utilizes a stretching method and is only detailed for illustrative purposes. Other methods for producing the rings have been contemplated.

At step S501, a single base ring and the number of required spinning bands are created, each from a single material (not necessarily all the same material). Next, at S502, all parts are coated in a particular color or other coating such that when later removed, high contrast patterns will be produced. At S503*a*, the indicators are laser etched onto the base ring. In step S504*a*, the pattern(s) are laser etched onto the spinning bands. Lasering may be done before or after combining the parts of the ring into a single unit, as shown in S503*b* and S504*b*. Depending on the flexibility of the lasering equipment available, it may be better for the lasering to be done to each constituent part prior to combining them. The lasering machine may be incapable of reliably manipulating and lasering the spinning bands once they are encompassed by the base ring. It may be preferred to combine all of the parts first and then perform all of the lasering in a single pass over the entire ring. Finally, the fitting process begins at step S505. First, the spinning bands are fit loosely over the base ring. Next, the base ring is stretched outwards until it encompasses the outer spinning band(s).

FIG. 6A exemplifies an alternate embodiment of the present disclosure. These rings are referred to as clicking rings. Unlike the dice rings previously described, these rings may be used to keep track of a combination of faces instead of producing random results. In FIG. 6A for example, the numbers lock or click into place. One example of a clicking ring may be a standard life counter ring 235, illustrated in FIG. 2C, in which a ring that can track digits 1 to 100 (represented as double zeros 00) can be used to track the life points of a character in a game, and able to be incremented and decremented as needed. Clicking rings are not limited to tracking life in games, but can be used to keep track of any value that exists on a particular version of a life counter.

Clicking ring 600 may include base ring 610, clicking bands 620, and a spring 630. Clicking bands 620 fit into the groove of base ring 600. Clicking ring 600 may not be spun due to the tension providing element, spring 630. Clicking bands 620 are locked at a specific value or combination of faces, and can be rotated by hand by gripping and putting twisting force on the bands, or by pushing on the band and then twisting. The notches 640 are made in such a way that this twisting force would automatically push two clicking bands 620 apart because of the angle or curve of the notches 640. Up and down pressure may cause the notches 610 and grooves to slide against each other, pushing the bands sideways and compressing the spring. In this way, the spring also holds the bands in place. The closer to a 0 degree slope the angle or curve has, the easier it is for twisting force to move the clicking bands apart and click to the next one over. A 90 degree slope means that no amount of twisting force would cause them to click over, and a zero degree slope would mean that nothing would be holding the symbols in place. In some examples included herein, a 45 degree angle is used. If the wearer pushes the band to be clicked towards the spring, compressing the spring, it takes pressure off of the notches and the band is much easier to rotate.

Base ring 610 may have lips 650 that may be pushed into each other and welded or cemented together using an adhesive, or otherwise merged/bonded together, similar to combining the parts of dice rings previously discussed. Either side of this base ring can be extended in length to accommodate more clicking bands 620, since this forms a single groove for all bands. Clicking rings do not require individual grooves. Notches 640 may hold the band in place. In this example, the number of notches 640 on a clicking ring 600 match the number of faces on the clicking band(s) 620 that the notches 640 match up with. This is so that when the clicking ring 600 comes to rest, one of its faces will always be aligned with the indicator mark.

Clicking rings with patterns with uneven faces, or in other words patterns that have faces that take up different amounts of surface area each, may have notches that are unevenly spaced too. The notches should, but do not have to, line up with the faces so that when they click into place, they line up with the indicator mark. This implies that the base band should only have a single protrusion; otherwise all notches may not line up perfectly with all protrusions and click into place in all positions. This is different from a clicking ring with perfectly even faces like the example clicking ring shown in FIG. 2C) because those notches are all the same distance from each other. This means the base band can have 10 protrusions to line up with the notches, because no matter what position the clicking band is in the notches will always line up with the protrusions.

Indicators 611 on base ring 610 are displayed as rectangles. However, as with other functional rings described herein, anything may be used as a marker as long as it contrasts the rest of the area of the base band. As with dice rings, indicators 611 on clicking ring 600 may be lasered, etched, or otherwise marked on base ring 610. In a preferred embodiment, indicator(s) 611 stand out and are centered across a row of faces, similar to a slot machine to ensure that the results from clicking band 620 are clear.

FIG. 6B illustrates a variety of tension providing elements that could be used to provide tension in a click ring, such as wave spring 630, wave washer 631, or rubber O-ring 632. For example, referring to FIG. 6A, spring 630 pushes the clicking bands against/into notches 640. Spring 630 may be a steel wave spring. The use of a wave spring adds convenience due to its compact size. However, one skilled in the art may use other comparable means such as other types of springs or other structures that are capable of pushing outwards in both directions, or otherwise causing the clicking bands to be forced together, such as wave washer 631, or rubber O-ring 632.

FIG. 6C is an exemplary embodiment of a clicking ring 600 with an alternative rounded design to the notches 660. Notches 660 may be of any shape that allows pressure up or down on a band to compress the spring and allow the band to click up and down.

FIG. 7A is an exemplary detailed embodiment of a triple-band clicking ring 700.

FIG. 7B represents isometric and sectional views of clicking ring 700. With this design, any number of bands could be stacked, requiring at least one clicking band 730, and zero or more clicking bands 720. Notches of clicking band 730 fit into the grooves of base ring 710. Clicking band 720 has notches on both sides, so any number of them could be put in between base ring 710 and clicking band 730. Spring 740 may be pushed all on one side and braced against the smooth side of the base ring, or it may have another series of clicking bands 720 and 730 on the opposite side, with another set of notches on that side of the base ring. This would look like an expanded double-band clicking ring, with a tension providing element in the middle, and any number of clicking bands on both sides of it.

FIGS. 7C-D are alternate views/embodiments of clicking rings. These embodiments exemplify that letters/numbers/symbols/etc., can be carved out as desired. For example, the letters/symbols of clicking bands 760, 761, and 762 have been carved using a stencil font. There are also 26 notches for the 26 letters of the alphabet. Since the faces have been carved out elements, indicator mark 750 can run across the entire ring, and it would be visible beneath the currently marked face. The indicator is not limited to just being on the sides of the base ring.

Additionally, clicking rings may be used for a variety of uses outside of numerical tracking. For example, referring to FIGS. 7C-D, indicator 751 shows two initials with a heart between them.

FIG. 8 illustrates another embodiment of a dice ring. Dice ring 800 shows a carved ring where the carving provides a protruding arrow. Dice ring 800 includes base band 810, spinner band 820, and indicator 830.

While various embodiments of the invention have been described, it will be apparent to those of ordinary skill in the art that many more embodiments and implementations are possible within the scope of the invention. Accordingly, the invention is not to be restricted, except as set forth in the following claims.

The invention claimed is:

1. A random result generating device comprising:
a base ring comprising at least one base ring component; and
at least one spinning band;
wherein the base ring has at least one groove;
wherein the spinning band fits into the at least one groove of the base ring;
wherein the at least one spinning band is spinnable inside the at least one grooved base ring;
wherein the base ring is marked with an indicator that designates a result of spinning the at least one spinning band;
wherein each of the at least one spinning bands is marked with a pattern covering the outer circumference of the at least one spinning band;
wherein the pattern comprises at least two faces;
wherein the random result generated is one of the faces of the pattern on each of the at least one spinning bands;
wherein the random result is designated by the indicator mark on the base ring; and
wherein the random result generating device is sized as wearable jewelry.

2. The device of claim 1 wherein the pattern is laser etched around the at least one spinning band.

3. The device of claim 1 wherein the indicator runs across the entire base ring.

4. The device of claim 1 wherein the surface area of each face is adjusted to match a probability distribution curve.

5. The device of claim 1 wherein the device is a wearable ring.

6. The device of claim 1 wherein the at least two faces comprises at least one of numbers, characters, symbols, or words distributed around the spinning band ring.

7. The device of claim 1 further comprising:
at least two spinning bands having
dividing ridges between the at least two spinning bands; and
wherein the dividing ridges prevent the at least two spinning bands from rubbing against each other or touching to each other.

8. The device of claim 1 further comprising:
a second indicator on the at least one base ring;
wherein the first and second indicators are parallel to each other and placed on opposite sides of the at least one base ring.

9. The device of claim 8 wherein the pattern is for one of a four sided die, a six sided die, an eight sided die dice, a ten sided die, a twelve sided die, and a twenty sided die.

10. The device of claim 1 wherein bearings are used between the at least one spinning band and the base ring, or as part of the at least one spinning band.

11. A device for keeping track of a combination of faces comprising:
a base ring comprising at least two base ring components;
at least one clicking band marked with a pattern covering the outer circumference of the clicking band;
wherein the clicking band is sized as wearable jewelry; and a tension providing element;
wherein the base ring is marked with an indicator that designates a result; wherein the pattern comprises at least two faces; wherein each face has a notch; wherein the at least one clicking band fits into a groove of the base band; and wherein an edge of a lip of the base ring that is adjacent to the at least one clicking band comprises at least one protrusion.

12. The device of claim 11 wherein the faces of the at least one clicking band lock or click into place in alignment with at least one indicator mark.

13. The device of claim 11 wherein the at least one clicking band is rotated by hand by gripping the at least one clicking band and placing twisting force on the clicking band.

14. The device of claim 11 wherein the indicator runs across the entire base ring.

15. The device of claim 11 wherein the notches of one clicking band fit into the grooves of another adjacent clicking band.

16. The device of claim 11 wherein the wearable device is a life counter ring.

17. The device of claim 11 wherein the tension providing element is a spring.

18. The device of claim 11 wherein the tension providing element is held between the at least one clicking band and an opposite smooth side of the base ring.

19. The device of claim 11 wherein the components of the base ring are permanently bonded.

20. The device of claim 11 further comprising:
two clicking bands;
wherein the tension providing element is trapped between the two clicking bands;
wherein each of the two clicking bands has a smooth side adjacent to the tension providing element and a notched side adjacent to the base ring; and
wherein each side of the base ring adjacent to its clicking band has matching protrusions to its adjacent clicking band.

* * * * *